US006863931B2

(12) United States Patent
Someno et al.

(10) Patent No.: US 6,863,931 B2
(45) Date of Patent: Mar. 8, 2005

(54) MANUFACTURING METHOD OF PRODUCT HAVING SPRAYED COATING FILM

(75) Inventors: Shinji Someno, Yokohama (JP); Akira Shimizu, Yokohama (JP); Hidenobu Matsuyama, Yokosuka (JP); Nobuyuki Kuroki, Funabashi (JP); Masanao Yomogizawa, Funabashi (JP); Ken Harada, Funabashi (JP); Tadahiro Shimadzu, Gifu (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/308,191

(22) Filed: Dec. 3, 2002

(65) Prior Publication Data

US 2003/0152699 A1 Aug. 14, 2003

(30) Foreign Application Priority Data

Dec. 3, 2001 (JP) ..... 2001-368832
May 2, 2002 (JP) ..... 2002-130600

(51) Int. Cl.[7] ..... C23C 4/08; C23C 4/12

(52) U.S. Cl. ..... 427/456; 427/446; 427/449; 427/236; 427/239

(58) Field of Search ..... 427/446, 449, 427/456, 236, 239

(56) References Cited

U.S. PATENT DOCUMENTS 3,013,528 A * 12/1961 Bland ..... 118/302
5,080,056 A * 1/1992 Kramer et al. ..... 123/193.4
5,271,967 A * 12/1993 Kramer et al. ..... 427/455
5,334,235 A * 8/1994 Dorfman et al. ..... 75/255
5,671,634 A * 9/1997 Donovan ..... 73/150 A
6,329,022 B1 * 12/2001 Schlegel et al. ..... 427/455
6,622,685 B2 9/2003 Takahashi

FOREIGN PATENT DOCUMENTS

JP 59-029056 * 2/1984
JP 7-62519 A 3/1995
JP 07-062518 7/1995

* cited by examiner

*Primary Examiner*—Katherine Bareford
(74) *Attorney, Agent, or Firm*—Foley & Lardner LLP

(57) ABSTRACT

A method of manufacturing a product having a sprayed coating film prepares a component having a cylindrical inner surface, prepares a gas spray type spraying gun with a central axis in opposed relationship with the cylindrical inner surface of the component to be aligned with a central axis of the cylindrical inner surface, supplies spraying material to the spraying gun, melts the spraying material with a combustion flame, and travels the spraying gun for translational movement in a traveling direction, corresponding to one of directions of the central axis of the cylindrical inner surface, for forming a sprayed coating film over the cylindrical inner surface while spraying the spraying material, molten with the combustion flame, onto the cylindrical inner surface in a spraying direction oriented in a rearward area of the traveling direction for thereby forming the sprayed coating film over the cylindrical inner surface.

13 Claims, 13 Drawing Sheets

MANUFACTURING METHOD OF PRODUCT HAVING SPRAYED COATING FILM

BACKGROUND OF THE INVENTION

The present invention relates to a manufacturing method of a product having a sprayed coating film and, more particularly, to a manufacturing method of a product having a sprayed coating film on a cylindrical inner surface.

Japanese Patent Application Laid-Open Publication No. H7-62519 discloses a method of forming a sprayed coating film over a bore inner surface, as a cylindrical inner surface, of a cylinder block of an engine.

In particular, with such a method, as shown in FIG. 12, a spraying gun 3 is used which is rotated in a direction as shown by an arrow A and moved in a vertical direction as shown by an arrow B within a member 1 having a cylindrical inner surface 1*a*. Connected to the spraying gun 3 are a plasma spraying machine 5, a powder feeder 7, a gas cylinder 11 and a gas cylinder 13. The powder feeder 7 accommodates therein powder-like spraying material 9 and is connected to a gas cylinder 17 in which powder feed gas, such as nitrogen, helium or the like, is stored.

With such a structure, the spraying gun 3 is supplied with the powder-like spraying material 9 from the powder feeder 7. Simultaneously, while being supplied with gases, such as argon, nitrogen, helium, hydrogen or the like from the gas cylinders 11, 13, or supplied with gas suitably mixed with those gases, a plasma spraying machine 5 forms a plasma arc at a spray nozzle 3*a* of the spraying gun 3. And, the spraying material 9 is melted in such-a plasma arc, and the melted spraying material 9 is sprayed on to the cylindrical inner surface 1*a* of the member 1 to form the sprayed coating film 15 over the cylindrical inner surface 1*a*.

SUMMARY OF THE INVENTION

However, upon studies conducted by the present inventors, since the combustion flame formed by the plasma spraying machine remains at a high temperature, there is a need for the spraying gun 3 to be vertically and repetitively moved for going and returning strokes, in order to avoid melting of a substrate material (a member 1 having a cylindrical inner surface 1*a*), to execute the spraying under a condition in which a traveling speed is increased.

In the meantime, if the spraying is continuously carried out while moving the spraying gun 3 for the going and returning stroke, it is conceivable that, when carrying out the spraying in a returning travel, there are probabilities where non-melted particles occurring in the going stroke are caught in the sprayed coating film, i.e., a so-called secondary adhesion occurs, resulting in deterioration in properties of the sprayed coating film, such as drop-off and peeling-off of the sprayed coating film and an increase in pores in the sprayed coating film. In particular, as shown in FIG. 13, it is found that there is a probability in which, in a cross section of the sprayed coating film 15 formed on the surface 1*a* of the substrate material (member 1), the non-melted particles PA are caught into the sprayed coating film 15.

Further, upon study of an orientation of the spray nozzle 3*a*, for instance, it becomes clear that in case of a structure where the spray nozzle 3*a* performs the spraying in a forward area of the traveling direction of the spraying gun 3, catching of such non-melted particles is apt to occur.

The present invention has been made upon studies described above and has an object of the present invention to provide a manufacturing method of a product having a sprayed coating film which is able to avoid the sprayed coating film from catching non-melted material and to effectively preclude properties of the sprayed coating film from being deteriorated.

Further, as a preceding step for forming such a sprayed coating film, for the purpose of increasing an adhesive force of the sprayed coating film, study has been conducted to provide a method of forming a bore inner surface of a cylinder block in a rough surface (Japanese Patent Application No. 2000-350056: not publicly known).

More particularly, as shown in FIG. 14A, a screw cutting tool (hereinafter merely referred to as the tool) 101 is used to perform cutting of a cylindrical inner surface 1*a* of a member. Also, in the figure, a direction in which the tool 101 is fed is designated by an arrow F, and a direction in which a swarf flows out is designated by an arrow O.

During such a cutting operation, various shapes appear in the swarf when formed in the screw cutting process in dependence on a speed (that depends on a pitch width of screw cutting) and a rake angle at which the tool 101 is fed. Here, if suitable discrimination is made to find out a proper shape of the swarf by preliminarily changing the feed speed and the rake angle of the tool 101 in various ways, it is possible to perform the processing such that the swarf of a recess portion 105 during the screw cutting operation is caused to positively interfere with the ridge portion.

Namely, when carrying out the screw cutting operation in such a case, setting is made not to cause the swarf to be involved only in the recess portion like in a general screw cutting operation but, as shown in FIG. 14B, to cause the swarf 109 to be unitarily formed such that not only the recess portion 105 but also the ridge portion 107 are scraped, thereby forming a fractured surface 111 in a remaining area of the ridge portion 107 which is scraped.

Thus, with the structure in which the cylindrical inner surface 1*a* of the member is formed with the recess portion 105 and the fractured surface 111, especially if the sprayed coating film is not formed in the fractured surface 111 or even if the sprayed coating film is formed, in a case where the sprayed coating film is extremely thin as compared to the sprayed coating film on the recess portion 105, there are occurrences in the properties of the sprayed coating film such as degradation in the adhesive force of the sprayed coating film, and drop-off and peeling-off of the sprayed coating film.

Accordingly, it is preferred that the sprayed coating film is formed on the recess portion 105 and the fractured surface 111 in a needed and adequate thickness and in a film surface as uniform as possible.

To this end, it is an object of the present invention to provide a manufacturing method of a product having a sprayed coating film which enables non-melted particles to be avoided from being caught in the sprayed coating film while the sprayed coating film is reliably formed on a recess portion to sufficiently enhance the sprayed coating film over a fractured surface to provide favorable film properties.

Further, it is conceived that there is a need for realizing a simplified structure suitable for enabling the sprayed coating film to be formed in a thin state to some extent to increase the adhesive force of the sprayed coating film formed in such a way for thereby increasing a flatness rate of the film.

Therefore, it is a further object of the present invention to provide a manufacturing method of a product having a sprayed coating film which enables the sprayed coating film to be formed in a thin state to provide an increase in a flatness rate and to increase an adhesive force of the sprayed coating film to provide the sprayed coating film with further excellent film properties.

According to one aspect of the present invention, a method of manufacturing a product having a sprayed coating film, comprises: preparing a component having a cylindrical inner surface; preparing a gas spray type spraying gun with a central axis in opposed relationship with the cylindrical inner surface of the component to be aligned with a central axis of the cylindrical inner surface; supplying spraying material to the spraying gun; melting the spraying material with a combustion flame; and traveling the spraying gun for translational movement in a traveling direction, corresponding to one of directions of the central axis of the cylindrical inner surface, and forming a sprayed coating film over the cylindrical inner surface while spraying the spraying material, molten with the combustion flame, onto the cylindrical inner surface in a spraying direction oriented in a rearward area of the traveling direction for thereby obtaining a product having the sprayed coating film on the cylindrical inner surface.

DETAILED DESCRIPTION OF THE PREFERRED EMBODIMENTS

Referring now to the accompanying drawings for convenience, products having sprayed coating films of various embodiments according to the present invention, related manufacturing methods thereof and spraying gun devices to be used in the methods are described below.

First Embodiment

First, referring to FIGS. 1A to 3, a method of manufacturing product having a sprayed coating film, or the like, in a first embodiment according to the present invention is described.

Figure 1A:
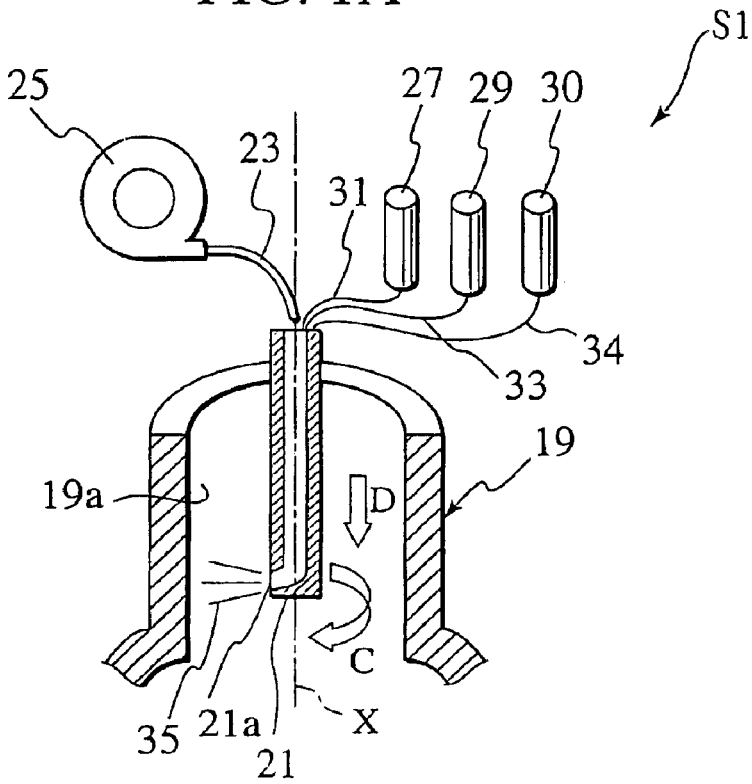
FIG. 1A is a schematic, partial cross sectional view illustrating a spraying gun device of a first embodiment according to the present invention and a step of preheating a cylindrical inner surface of a component when used with the spraying gun device to form a sprayed coating film over a cylindrical inner surface of the component.
Figure 1B:
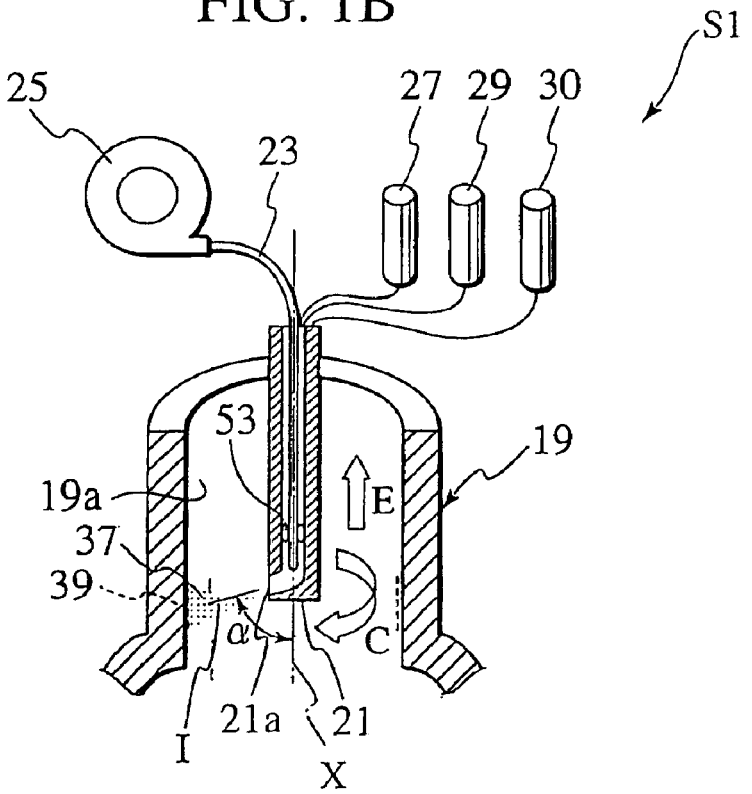
FIG. 1B is a schematic, partial cross sectional view illustrating a step of spraying molten particles onto the cylindrical inner surface of the component subsequent to the step shown in FIG. 1A.

FIG. 1A is a schematic, partial cross sectional view illustrating a structure of a spraying gun device S1 of the presently filed embodiment and a step of preheating a cylindrical inner surface of a component when forming the splayed coating film over the cylindrical inner surface of the component using such a spraying gun device, and FIG. 1B is a schematic, partial cross sectional view illustrating a step of spraying molten particles onto the cylindrical internal surface of the component subsequent to the step shown in FIG. 1A.

As shown in FIGS. 1A and 1B, the presently filed embodiment is described below as being applied to a cylinder block, made of aluminum alloy, for an engine of an automobile as a component 19 having a cylindrical inner surface, and the cylindrical inner surface 19*a* of the component 19 is described as a bore inner surface of such a cylinder block. Further, it is supposed that the cylinder block 19 is preliminarily subjected to a desired casting step and a machining step and, after executing the casting step, the bore inner surface 19*a* is machined in a desired roughness. Then, the gas wire flame type spraying gun 21 is inserted through the bore inner surface 19*a* in opposition to the bore inner surface 19*a* while keeping a central axis of the spraying gun 21 in alignment with a central axis X of the bore inner surface 19*a*, thereby allowing iron-metallic material to be sprayed, as a spraying material, from a spray nozzle 21*a* onto the bore inner surface 19*a* to form a sprayed coating film thereon.

More particularly, with the spraying gun device S1, the spraying gun 21 is supplied with a wire 23, which includes iron-metallic material composed of a principal element of iron as a spraying material, from a wire feeder 25, fuel gas through a pipe 31 from a fuel gas cylinder 27 containing fuel such as acetylene, propane or ethylene, and oxygen gas through a pipe 33 from an oxygen cylinder 29 that contains oxygen, combusting fuel gas and oxygen gas to form a combustion flame 53 to cause the wire 23 to be molten. Further, the spraying gun 21 is supplied with compressed air through a pipe 34 from a compressor 30 to cause the wire 23, in the form of molten spraying material, to be sprayed onto the bore inner surface 19*a,*

Further, the spraying gun 21 is rotatable about a central axis X as shown by an arrow C and is able to travel for translational movement in going and returning strokes with respect to the bore inner surface 19*a* as shown by arrows D and E.

Furthermore, the spray nozzle 21*a* of the spraying gun 21 is not oriented at a right angle with respect to the bore inner surface 19*a* and is inclined at an angle of $\alpha$=80° with respect to the central axis X of the spraying gun 21 such that the spray nozzle 21*a* is inclined rearward with respect to a direction E in which the translational movement is carried out in the returning stroke, as shown FIG. 1B. Also, it is to be noted here that, unless a special mention is made in the presently filed embodiment and subsequently filed embodiments, the angle is referred to as an acute component.

Next, a more detailed description is given to a method of manufacturing the cylinder block 19 having the sprayed coating film using the spraying gun device S1, with the structure mentioned above, for forming the sprayed coating film 39 over the bore inner surface 19*a* of the cylinder block 19.

First, to summarize spraying conditions of the presently filed embodiment, the wire 23 is fed at a feed rate selected to fall in a range between 900 and 1600 mm/min, the spraying gun 21 is rotated at a speed selected to fall in a range between 2500 and 3500 rpm, the spraying gun 21 is traveled at a traverse speed (at a going and returning speed in a vertical direction) selected to fall in a range between 90 and 160 mm/min, the spraying angle $\alpha$ is selected to be 80°, the pressure at which oxygen gas is supplied from the oxygen gas cylinder 29 is selected to fall in a range between $29.4\times10^4$ and $53.9\times10^4$Pa, the flow rate at which oxygen gas is supplied from the oxygen cylinder 29 is selected to fall in a range between 48.3 and 139.3 l/min, the pressure at which fuel gas is supplied from the fuel gas cylinder 27 is selected to fall in a range between $9.8\times10^4$ and $34.3\times10^4$Pa, the flow rate at which fuel gas is supplied from the fuel gas cylinder 27 is selected to fall in a range between 8.6 and 22.3 l/min, and the pressure at which compressed air is supplied to the spraying gun 21 is selected to fall in a range between $34.3\times10^4$ and $68.6\times10^4$Pa. Such conditions are listed in Table 1.

TABLE 1

| | |
|---|---|
| Spraying Material Feed Speed (mm/min) | 900~1600 |
| Rotational Speed (rpm) of Spraying Gun | 2500~3500 |
| Traverse Speed (mm/min) of Spraying Gun | 90~160 |
| Spraying Angle (° ) | 80 |
| Oxygen Gas Pressure (Pa) | $29.4 \times 10^4$~$53.9 \times 10^4$ |
| Oxygen Gas Flow Rate (1/min) | 48.3 ~139.3 |
| Fuel Gas Pressure (Pa) | $9.8 \times 10^4$~$34.3 \times 10^4$ |
| Fuel Gas Flow Rate (1/min) | 8.6 ~22.3 |
| Compressed Air Pressure (Pa) | $34.3 \times 10^4$~$68.6 \times 10^4$ |

Under the spraying conditions set forth above, initially, as shown in FIG. 1A, the spraying gun 21 is rotated in the direction as shown by the arrow C and traveled downward in the going stroke as shown by the arrow D. During such a translational downward travel, the wire feeder 25 is inoperative to feed the wire 23, and mixed gas of fuel gas and oxygen gas fed from the fuel gas cylinder 27 and the oxygen gas cylinder 29 is ignited to form the combustion flame 35. And, such a combustion flame 35 is sprayed onto the bore inner surface 19*a* to achieve preheating of an entire area of the bore inner surface 19*a*.

Subsequently, if the spraying gun 21 is traveled toward a lower end of the bore inner surface 19*a*, as shown in FIG. 1B, then the spraying gun 21 is traveled upward in the returning stroke as indicated by the arrow E while rotated in the direction as shown by the arrow C. During such an upward translational movement, the wire 23 is fed from the wire feeder 25 to cause the wire 23 to be molten with the combustion flame 53, formed by igniting the mixed gas of fuel gas and oxygen gas supplied from the fuel gas cylinder 27 and the oxygen gas cylinder 29, such that the molten particles (which are sometimes referred to as spraying particles) 37 are sprayed from the spray nozzle 21*a* onto the entire area of the bore inner surface 19*a* to form the sprayed coating film 39 over the entire area of the bore inner surface 19*a* to obtain the cylinder block 19 having such a sprayed coating film 39.

In particular, it was confirmed that the area of the bore inner surface 19*a*, corresponding to the bore inner diameter of approximately 90 mm with a height of 120 mm, was favorably formed with the sprayed coating film 39 with a film thickness in a range between 100 $\mu$m and 400 $\mu$m.

Figure 2:
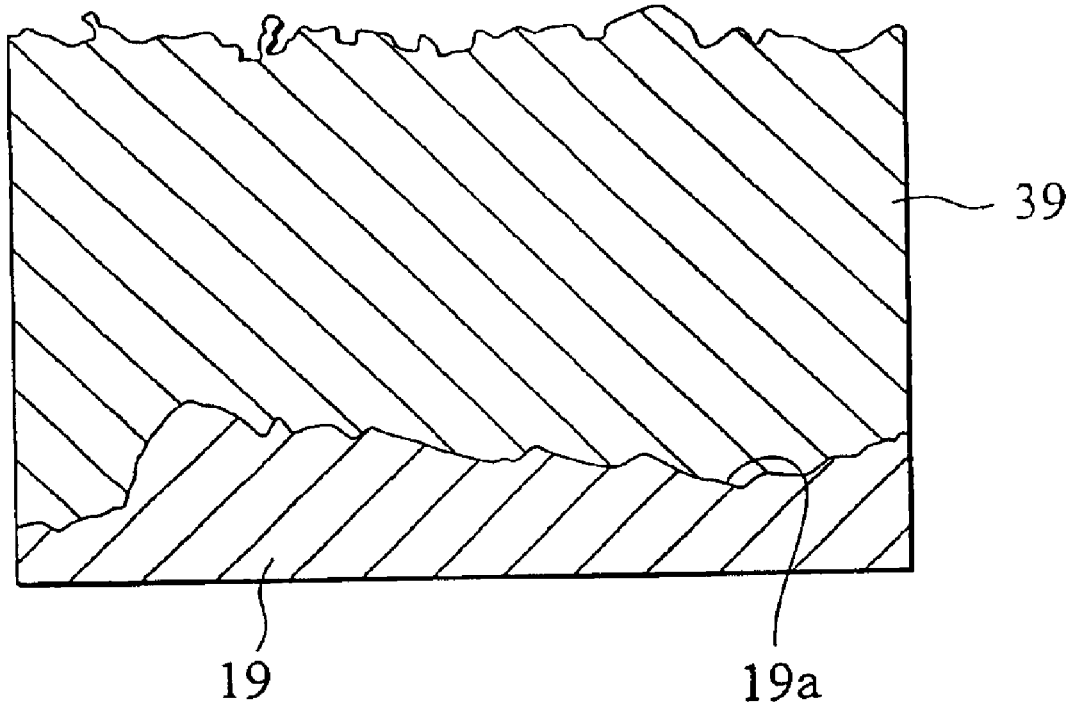
FIG. 2 is a schematic cross sectional view of the component illustrating a status where the sprayed coating film is formed over the cylindrical inner surface of the component through the steps shown in FIGS. 1A and 1B.

FIG. 2 is a schematic cross sectional view, when observed with a microscope, of a cross section in a status where the sprayed coating film 39 is formed over the surface (the bore inner surface 19*a*) of the cylinder block 19 serving as a substrate material, and referring to FIG. 2, it appears that there is no occurrence of non-melted particles caught in the sprayed coating film.

With the structure set forth above, the forming step of the sprayed coating film 39 is carried out by traveling the spraying gun 21 upward for one time (in the returning stroke), i.e., in one-way translational movement, and during such travel, the direction I in which the spraying is made by the spray nozzle 21*a* is set to be oriented at the angle of 80° with respect to the central axis X to allow the spray nozzle to be oriented toward a rearward side in a direction in which the spray gun 21 is traveled for the translational movement, as shown FIG. 1B. In this way, the catching of the non-melted particles into the sprayed coating film 39 can be avoided to preclude properties of the sprayed coating film from being deteriorated, thereby obtaining the sprayed coating film 39 with excellent film properties in a high reliability.

Further, since the combustion flames 35, 53 are formed by the gas wire frame type spraying gun 21 at a lower temperature than that of a plasma type, even when the sprayed coating film 39 is formed over the entire area of the bore inner surface 19*a* in the upward movement for one time, no melting of the bore inner surface 19*a* substantially occurs to enable the sprayed coating film 39 to be obtained in a further reliable manner.

Furthermore, during the returning stroke in which the molten particles 37 are sprayed onto the bore inner surface 19*a*, since the bore inner surface 19*a* is preheated during the downward going stroke of the spraying gun 21, an adhesive force of the sprayed coating film 39 is increased and, thus, it becomes possible to obtain the sprayed coating film 39 having a high reliability.

Moreover, since the bore inner surface 19*a* of the cylinder block 19 made of aluminum alloy is sprayed with iron-metallic material made of the principal element of iron serving as the spraying material, it is possible to achieve a lightweight structure required for the cylinder block with no need of mounting a cylinder liner, made of iron-metallic material, into the bore inner surface, i.e., with no increase in the number of component parts Also, while such a cylinder block 19 has been described in conjunction with an exemplary case where the step of forming and the step of machining are preliminarily carried out, it is of course able to permit an additional processing to be carried out after the casting step of the sprayed coating film 39 provided that no adverse affect is applied to the sprayed coating film 39.

Figure 3:
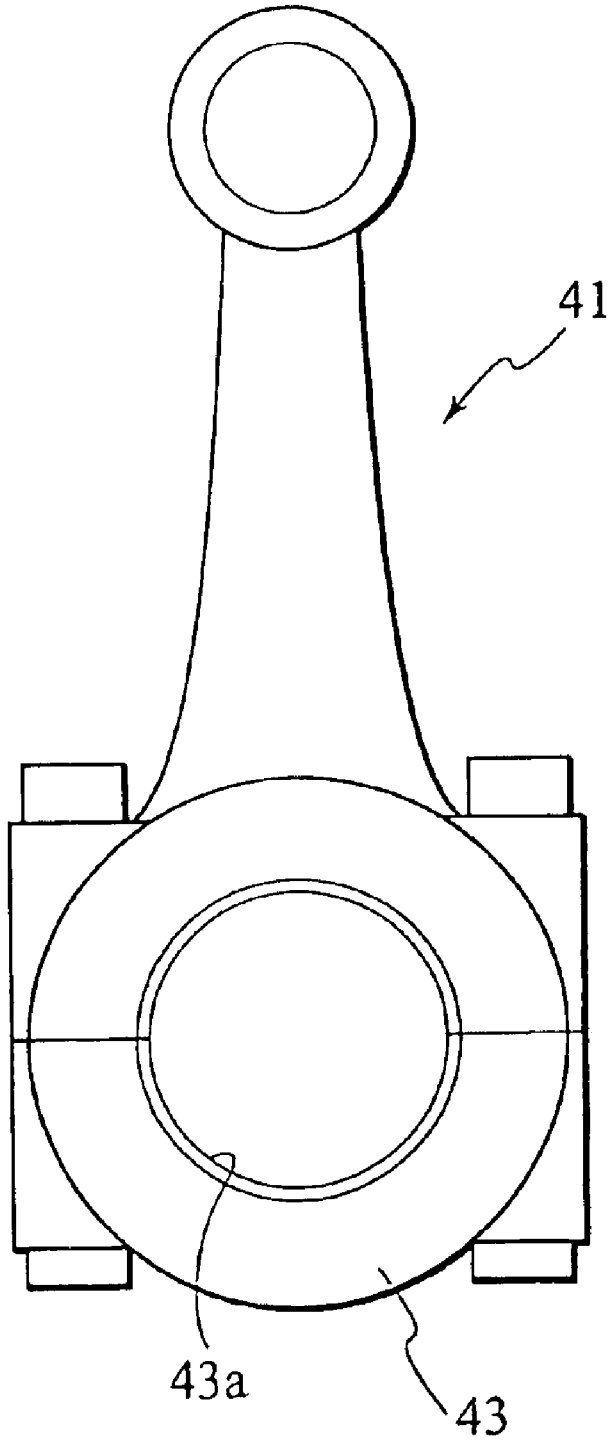
FIG. 3 is a front view of a connecting rod for use as another example of the component having the cylindrical inner surface in the presently filed embodiment.

In the meantime, the sprayed coating film set forth above is of course not intended to be limited to be applied to the bore inner surface of the cylinder block and, as shown in FIG. 3, a connecting rod 41, made of iron-material made of a principal element of iron, may be used as a component having a cylindrical inner surface to allow an inner surface 43*a* of a large terminal portion 43 to be applied with the same steps as those applied to the bore inner surface of the cylinder block such that the inner surface is sprayed with metallic material of aluminum-copper, made of a principal element of an alloy containing aluminum and copper, as a spraying material to form the sprayed coating film.

With such a structure, a metal sheet for the inner surface 43*a* of the large terminal portion 43 can be dispensed with, effectively resulting in a decrease in the number of component parts. Also, in general, the metal sheet has a thickness of approximately 1.5 mm and, on the contrary, since the sprayed coating film can be formed in a reduced thickness ranging from 0.1 mm to 0.4 mm, a lightweight structure can be effectively achieved.

Second Embodiment

Referring now to FIGS. 4A to 6, a method of manufacturing a product having a sprayed coating film, or the like, according to a second embodiment of the present invention is described below. The presently filed embodiment has the same structure as that of the first embodiment except for the use of a cylinder block, having a bore inner surface preliminarily formed in a coarse state by a screw cutting process to form a fractured surface, and a connecting rod having a large terminal portion formed with an inner surface formed in such a coarse state, and like parts bear the same reference numerals as those of the first embodiment to suitably simplify or to omit redundant description, with a description being given below mainly in conjunction with such different points.

Figure 4B:
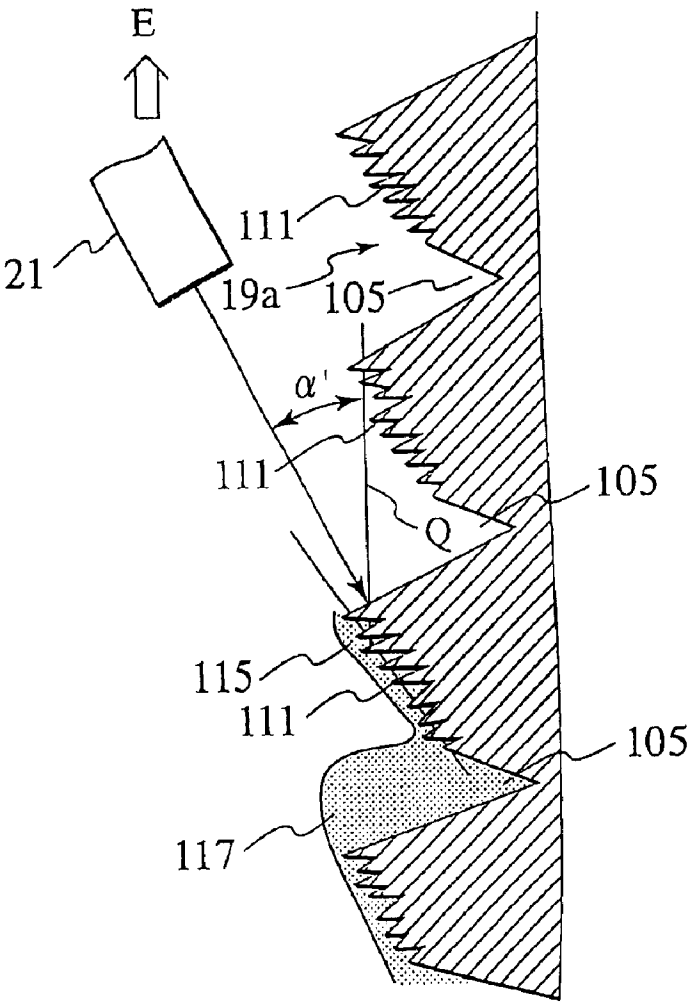
FIG. 4B is a schematic cross sectional view illustrating a status where the sprayed coating film is formed in a non-uniform manner in a cross section shown in FIG. 4A.
Figure 4A:
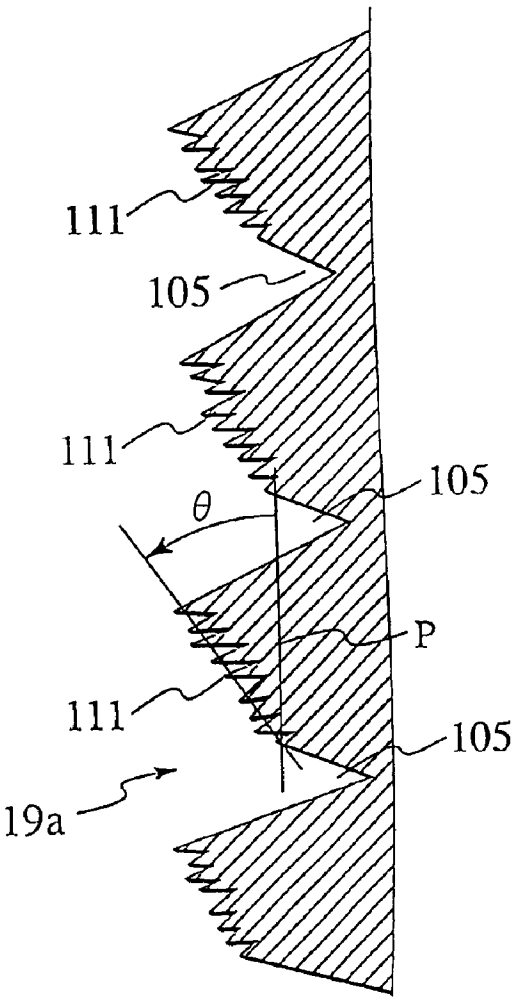
FIG. 4A is a schematic cross sectional view illustrating detailed configurations of a recess portion and a fractured surface obtained by performing cutting operation of the cylindrical inner surface of the component with the use of a screw cutting process tool according to studies conducted by the inventors in a second embodiment according to the present invention.

FIG. 4A is a schematic cross sectional view illustrating detailed shapes of recess portions and fractured surfaces obtained by cutting the cylindrical inner surface of the component using a screw cutting tool, and FIG. 4B is a schematic cross sectional view illustrating a status where the cross section shown in FIG. 4A is formed with the sprayed coating film.

Upon studies conducted by the present inventors, it has become clear that, when cutting the cylindrical inner surface 19*a* of the component 19 by using the screw cutting tool so as to cause a swarf of the recess portion 105, formed during the screw cutting operation, to positively interfere with a ridge portion, owing to the feed speed of and a rake angle of the tool, as shown in FIG. 4A, the fractured surface 111 is inclined at an angle of $\theta$ ($20° \leqq \theta \leqq 44°$) with respect to the axial direction (as indicated by a straight line P in parallel to the central axis X of the cylindrical inner surface 19*a*).

On the other hand, as previously described with reference to the first embodiment, when forming the sprayed coating film after the screw cutting operation, as shown in FIG. 4B, the spraying gun 21 is traveled in the axial direction as shown by the arrow E with respect to the cylindrical inner surface 19*a* of the component and, when this takes place, it is preferable for the spraying gun 21 to perform the spraying in a direction oriented rearward (in a direction opposite to the direction shown by the arrow E) along the direction of the translational movement of the spraying gun 21 such that the spraying is conducted at an inclined angle $\alpha'$ (with a resultant angle equal to the value of $\alpha$ as one of alternate angles at both ends) with respect to the direction of the axis (indicated at a straight line Q in parallel to the central axis X of the cylindrical inner surfaces 19*a*).

With such a structure, in principal, it is possible to avoid the spraying conditions from varying, owing to a rebounding effect of the molten particles against a distal end of the spraying gun 21, and to avoid the non-melted particles from being caught into the sprayed coating film while enabling the sprayed coating film to be formed over the recess portions 105.

By the way, upon studied conducted more in detail, if the inclined angle $\alpha'(=\alpha)$ of the spraying direction becomes less than the inclined angle $\theta$ (briefly, below 44°) of the fractured surface 111, no sprayed coating film is formed over the fractured surface 111 or even if the sprayed coating film is formed, as shown FIG. 4B, the sprayed coating film 115 formed over the fractured surface 111 becomes thinner than the sprayed coating film 117 formed over the recess portion 105, resulting in deterioration in the properties of the sprayed coating film such as degradation in the adhesive force of the sprayed coating film, and occurrences of dropping out and peeling-off of the sprayed coating film.

Figure 5B:
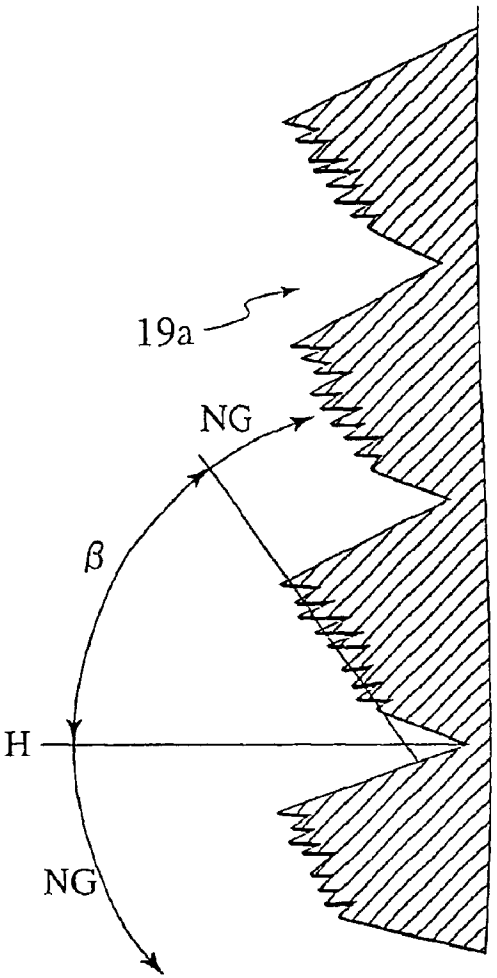
FIG. 5B is a schematic cross sectional view illustrating a range of an inclined angle of the spraying gun in the cross section shown in FIG. 4A.
Figure 5A:
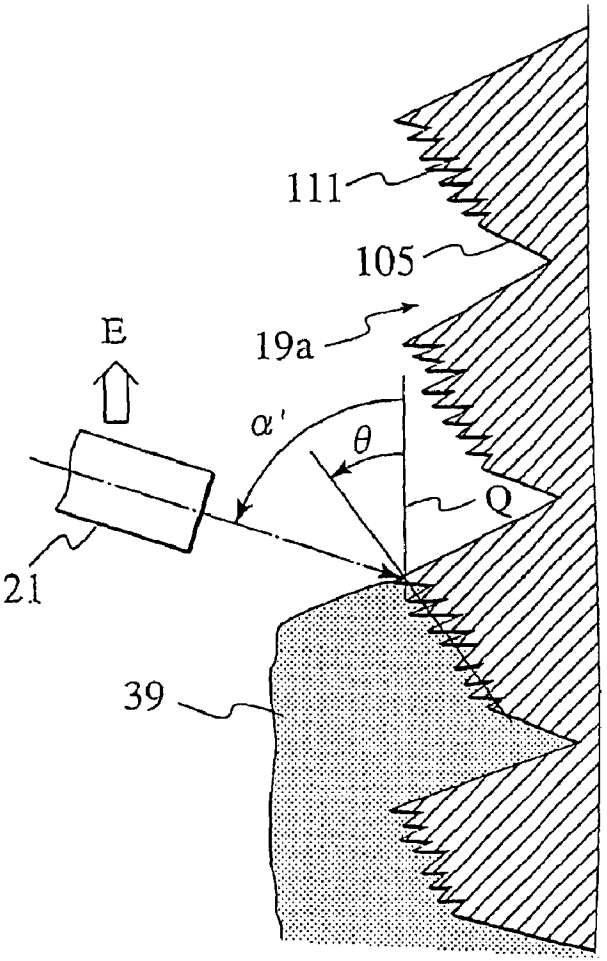
FIG. 5A is a schematic cross sectional view illustrating a status where the sprayed coating film is formed in a uniform manner in the cross section shown in FIG. 4A.

To this end, as a result of conducting the study about conditions wherein the sprayed coating film is uniformly formed as shown in FIGS. 5A and 5B, it becomes clear that it is preferable for the inclined angle $\alpha'(=\alpha)$, oriented in the spraying direction of the spray nozzle 21, with respect to the direction of the axis (shown by the arrow Q) in the cylindrical inner surface 19*a* of the component to be greater than the inclined angle $\theta$ with respect to the straight line Q of the fractured surface 111.

Namely, in consideration of the situation where the translational movement of the spraying gun 21 during the spraying operation is oriented in the direction as shown by the arrow E in FIG. 5A and the inclined angle θ of the fractured surface 111 falls in the range $20° \leqq \theta \leqq 44°$, it becomes preferable for the inclined angle $\alpha'(=\alpha)$ of the spraying gun 21 to fall in a range $44° < \alpha'(=\alpha) < 90°$. In other word, an angle β of the spraying gun 21, shown in FIG. 5B, may preferably fall in an allowable range $0° < \beta < 46°$. Also, a straight line H in FIG. 5B represents a diametric direction that intersects the axial direction (the direction shown by the straight line Q in FIG. 5A) of the cylindrical inner surface 19*a* of the component.

Figure 6:
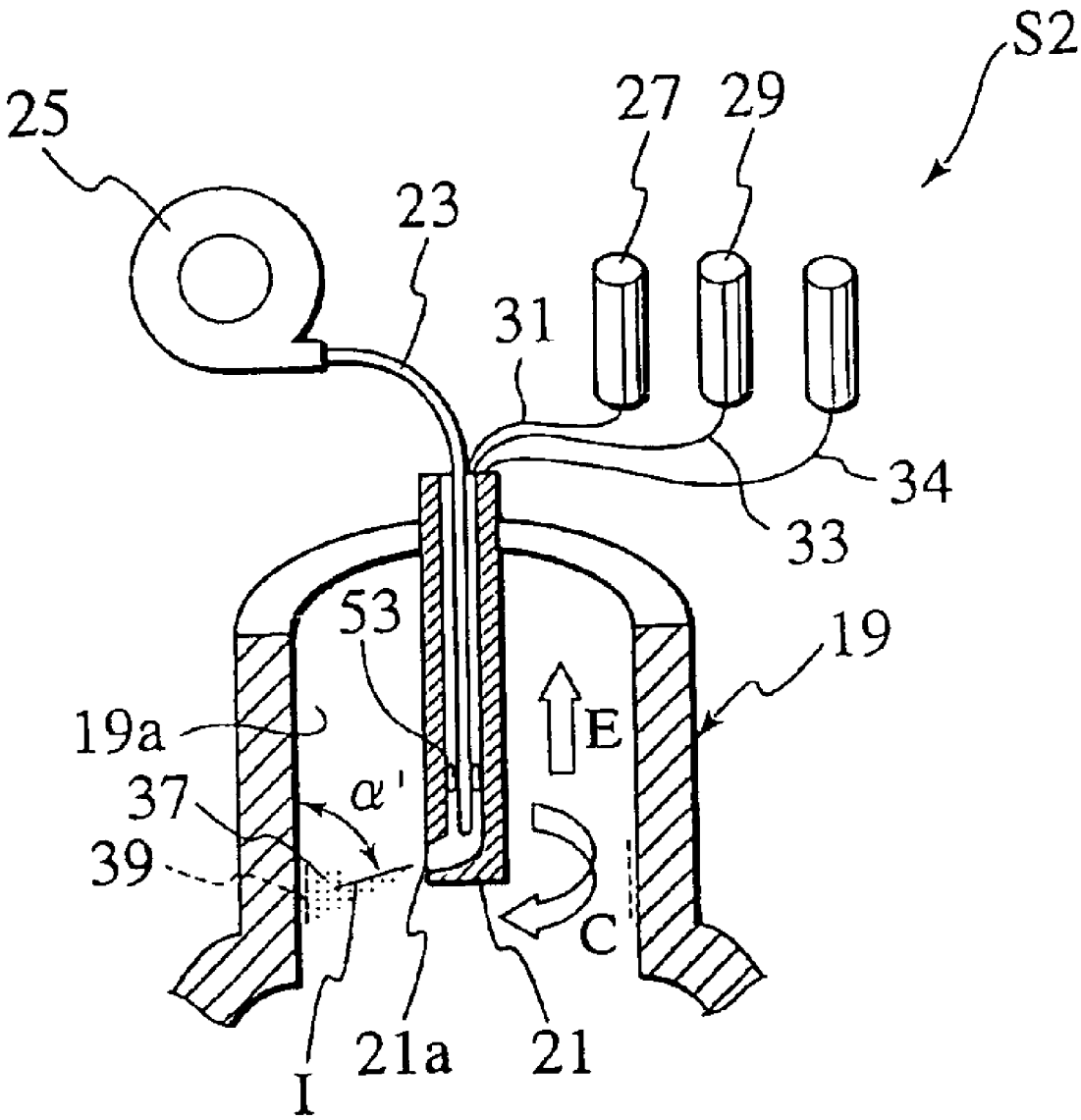
FIG. 6 is a schematic cross sectional view illustrating a step of spraying molten particles onto the cylindrical inner surface of the component using the spraying gun device of the presently filed embodiment.

A summary of a structure of steps of preheating the cylindrical inner surface of the component using the spraying gun device S2 of the presently filed embodiment, to which such a spraying gun 21 set with the inclined angle $\alpha'(=\alpha)$ is applied, and subsequently forming the sprayed coating film over the cylindrical inner surface of the component is described in FIG. 6. Since such steps are carried out under the same spraying conditions as those of the first embodiment except for the step shown in FIG. 1B, together with the precisely defined value of the inclined angle α of the spraying gun 21 for thereby obtaining the cylinder block having the sprayed coating film, a detailed description is herein omitted.

Further, the sprayed coating film set forth above can also be applied to the connecting rod in the same way as that of the first embodiment and, even in a case where the inner surface of the large terminal portion is subjected to the screw cutting operation, the sprayed coating film can be reliably formed using the same inclined angle of the spraying gun as that described in connection with the cylinder block.

With such a structure, the number of component parts can be reduced, while achieving a lightweight structure.

Third Embodiment

Referring now to FIGS. 7 to 10C, a method of manufacturing a product having a sprayed coating film, or the like, in a third embodiment according to the present invention is described below. The presently filed embodiment has a structure wherein directions in which a hot blast and spraying particles of the spraying gun are injected can be varied and, as a result, since the third embodiment has the same structure as that of the first embodiment except for a capability of providing the sprayed coating film with more excellent film properties in an increased degree of freedom, like parts bears the same reference numerals as those of the first embodiment to describe the presently filed embodiment principally in connection with the different points in a suitably simplified form or to omit the description.

Figure 7:
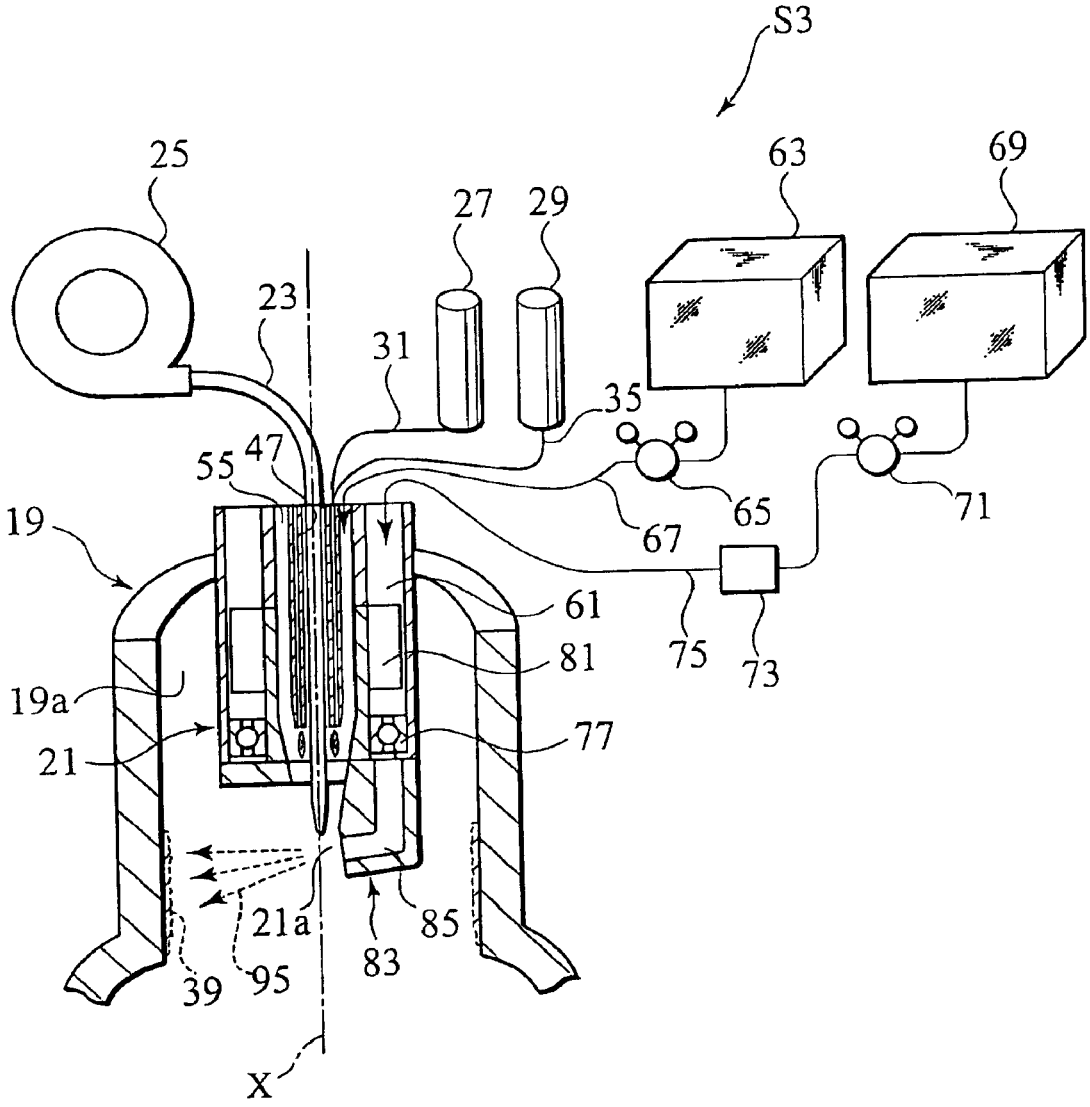
FIG. 7 is a schematic cross sectional view illustrating a spraying gun device of a third embodiment according to the present invention.
Figure 8:
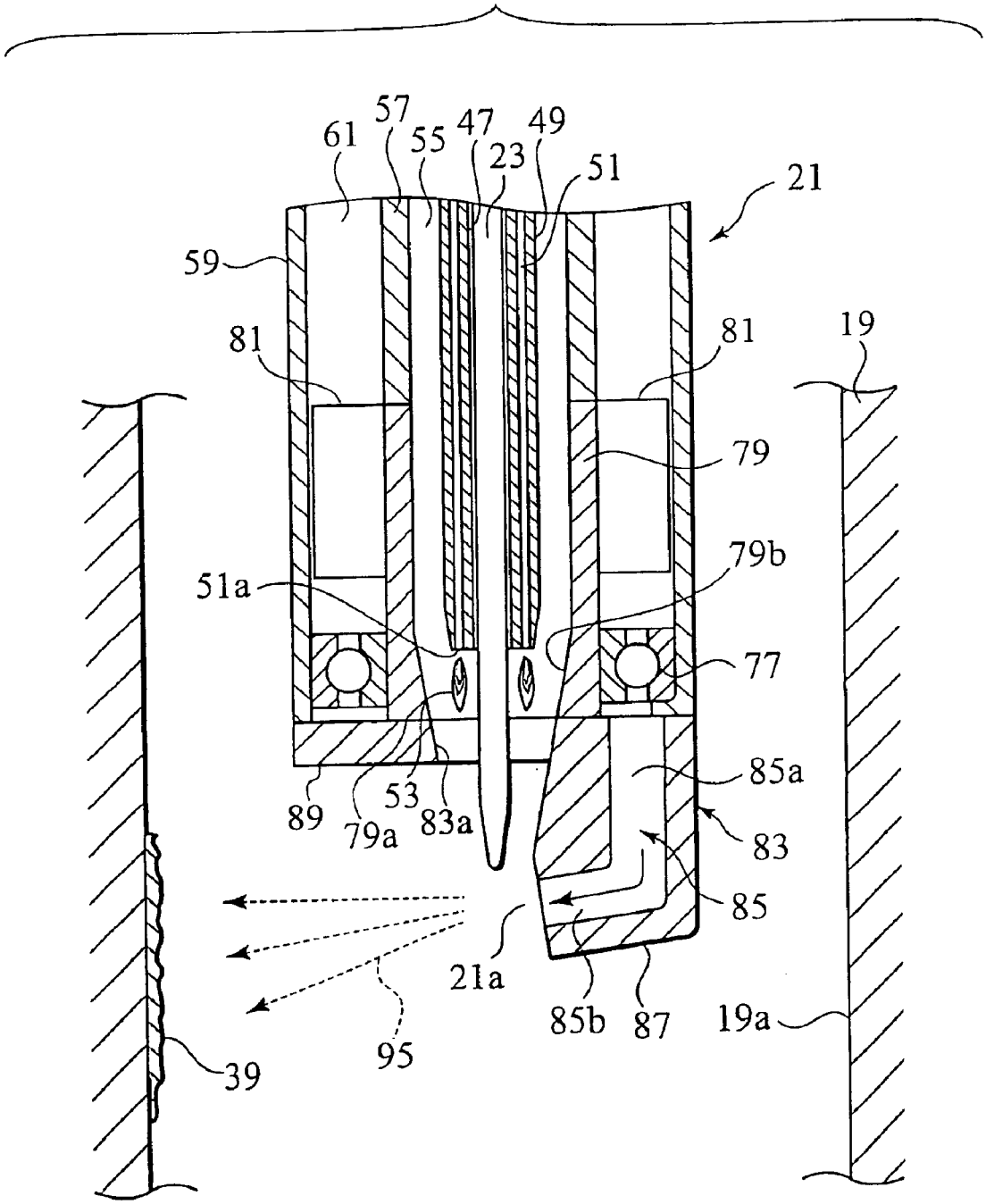
FIG. 8 is an enlarged detail cross sectional view of an essential part with a terminal end of the spraying gun of the presently filed embodiment being shown in an enlarged scale.

FIG. 7 is a schematic, partial cross sectional view illustrating an overall structure of a spraying gun device S3 of the presently filed embodiment, and FIG. 8 is an enlarged detail cross sectional view of a principal part illustrating a terminal end of the spraying gun of the spraying gun device S3 of the presently filed embodiment in an enlarged scale.

As shown in FIGS. 7 and 8, with the presently filed embodiment, the cylindrical inner surface of the component includes the bore inner surface 19*a* of the cylinder block 19, made of aluminum alloy, for an automobile engine, and the spraying gun 21 is inserted through the bore inner surface 19*a* along the central axis X thereof such that the central axis of the spraying gun 21 is aligned with the X axis to allow the molten iron-metallic material to be sprayed as the spraying material from the spray nozzle 21*a* for thereby causing the sprayed coating film to be formed over the bore inner surface 19*a*.

More particularly, the spraying gun 21 is supplied with the wire 23 of iron-metallic material as the spraying material from the wire feeder 25 and also supplied with fuel gas and oxygen gas from the fuel gas cylinder 27, storing fuel such as acetylene, propane and ethylene, and the oxygen gas cylinder 29, storing oxygen, via the pipes 31 and 33, respectively.

The wire 23 is inserted through a wire feed aperture 47, vertically extending through a central portion and serving as a feeder section for the spraying material, from an upper end thereof and fed downward. Also, fuel gas and oxygen gas are supplied to a gas guide flow passage 51 that is formed in a cylindrical portion 49 at an area outside the wire feeder aperture 47 and vertically extends therethrough. Mixed gas of fuel gas and oxygen gas, thus supplied in such a way, flows out from a lower end opening portion 51*a* of the gas guide flow passage 51 and is ignited to form a combustion flame 53.

At an outer circumferential periphery side of the cylindrical portion 49, an atomizing air flow passage 55 is formed as a first gas flow passage. Further, at a further outer circumferential periphery side, an accelerator air flow passage 61 is formed as a second gas flow passage between a partition wall 57 and an outer wall 59 both formed in cylindrical shapes.

Atomizing air flowing through the atomizing air flow passage 55 as first gas delivers heat of the combustion flame 53 in a forward area (downward in FIG. 8), while cooling a peripheral area thereof, and delivers the molten wire 23 in the forward area. On the other hand, accelerator air serving as second gas flowing through the accelerator air flow passage 61 injects the molten wire 23, thus delivered to the forward area, as molten particles 95 (that correspond to the molten particles 37 in the first embodiment) toward the bore inner surface 19*a* in a direction intersecting the feed direction of the wire 23 to cause the sprayed coating film 39 to be formed over the bore inner surface 19*a*.

Here, the atomizing air flow passage 55 is supplied with atomizing air from an atomizing air supply source 63 through an air supply pipe 67 equipped with a pressure reduction valve 65. On the other hand, the accelerator air flow passage 61 is supplied with accelerator air from an accelerator air supply source 69 through an air supply pipe 75 equipped with a pressure reduction valve 71 and a micromist filter 73. Namely, the atomizing air flow passage 55 and the accelerator flow passage 61 are disposed in mutually separate systems.

The partition wall 57 between the atomizing air flow passage 55 and the accelerator air flow passage 61 has a lower side formed with an end portion which is equipped with a rotational cylinder portion 79 that is rotatable via a bearing 77 relative to the outer wall 59. Fixed at an upper peripheral portion of the rotational cylinder portion 79 is a rotational blade 81 which is disposed in the accelerator air flow passage 61. The presence of accelerator air flowing through the accelerator air flow passage 61 and acting on the rotational blade 81 allows the rotational blade 79 to rotate.

Fixedly secured to a terminal end surface 79*a* of a lower end of the rotational cylinder portion 79 is a terminal member 83 that rotates integrally with the rotational cylinder portion 79. Formed at a portion of a circumferential edge of the terminal member 83 is a protruding portion 87 that is formed with a jet stream flow passage 85 which communicates with the accelerator air passage 61 via the bearing 77. Also, the bearing 77 has fine gaps to allow delivery of accelerator air therethrough.

The jet stream flow passage 85 is comprised of a base flow passage 85*a* continuous with the accelerator air flow passage 61 on the substantially same straight line therewith, and a terminal flow passage 85*b* that is curved at a lower end of the base flow passage 85*a*, at an angle of 80° with respect to the central axis X of the bore inner surface 19*a*, so as to open toward the bore inner surface 19*a*. A terminal opening of the terminal flow passage 85*b* forms the spray nozzle 21*a* of the spraying gun 21.

Formed in a circumferential periphery portion at an area except for the protruding portion 87 of the terminal member 83 is a plate-like portion 89 by which the terminal opening of the accelerator air flow passage 61 is covered.

The atomizing air flow passage 55 includes slanted walls 79*b*, 83*a* which are formed such that a terminal portion, i.e., a distal end of the rotational cylinder portion 79 and an area formed in the terminal member 83 are tapered.

Figure 9:
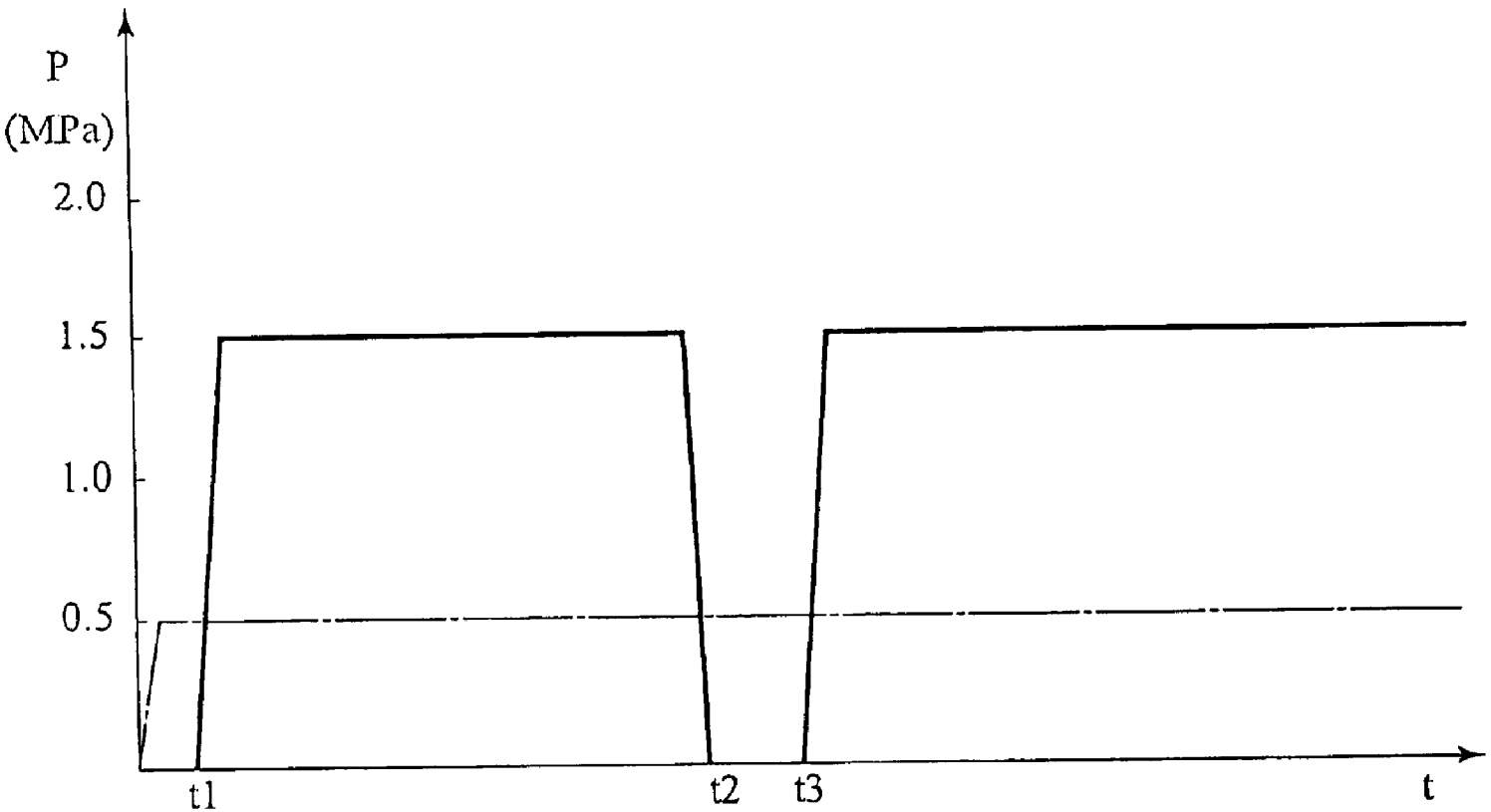
FIG. 9 is a view illustrating a timing chart of operations of the spraying gun device of the presently filed embodiment.
Figure 10A:
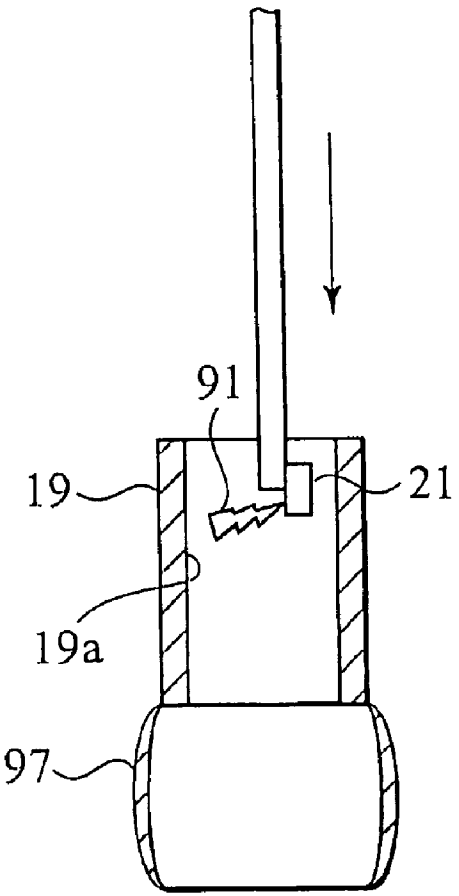
FIG. 10A is a schematic, partial cross sectional view illustrating a step of preheating a cylindrical inner surface of a component when forming the sprayed coating film over the cylindrical inner surface of the component in the presently filed embodiment.
Figure 10B:
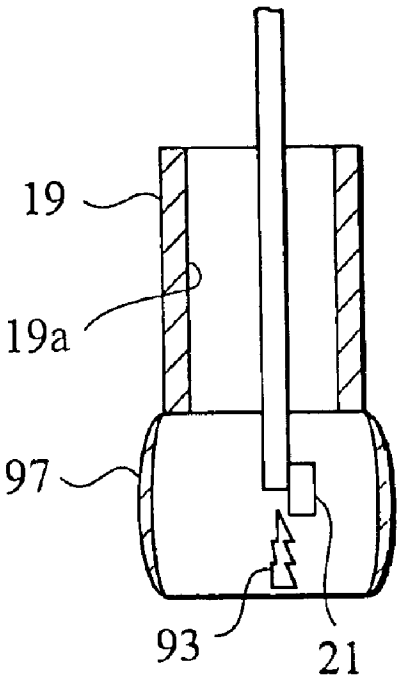
FIG. 10B is a schematic, partial cross sectional view illustrating a step of supplying a spraying material subsequent to the step shown in FIG. 10A.
Figure 10C:
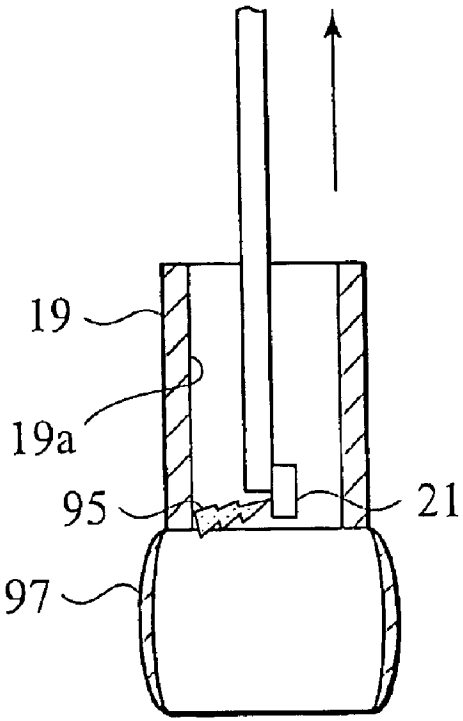
FIG. 10C is a schematic, partial cross sectional view illustrating a step of spraying molten particles onto the cylindrical inner surface of the component subsequent to the step shown in FIG. 10B.

Now, referring to FIG. 9 which illustrates a time chart indicative of the relationship between time t and a pressure P associated with atomizing air and accelerator air and FIGS. 10A to 10C which illustrate operations, a detailed description is given to a method of manufacturing the cylinder block 19 having the sprayed coating film by using the spraying gun device S3 with the structure set forth above to cause the sprayed coating film to be formed over the bore inner surface 19*a* of the cylinder block 19. Also, in FIG. 9, a time variation in pressure of atomizing air is plotted in a single dot line, and a time variation in pressure of accelerator air is plotted in a solid line.

First, fuel gas and oxygen gas are supplied to the gas guide flow passage 51 from the fuel gas cylinder 27 and the oxygen gas cylinder 29, respectively, and mixed gas emitting from the lower opening portion 51*a* of the gas guide flow passage 51 is ignited to form the combustion flame 53. When this takes place, atomizing air begins to be supplied to the atomizing air flow passage 55 under a pressure of 0.5 MPa reduced by the pressure reduction valve 65. Since the supply of atomizing air causes the heat developed by the combustion flame 53 to be delivered downward for escape, temperature rises in peripheral component parts are avoided, thereby achieving a cooling effect in the peripheral component parts.

Subsequently, when a given time interval $t_1$ is elapsed after atomizing air begins to be supplied, the accelerator air flow passage 61 is supplied with accelerator air, under the pressure of 1.5 MPa reduced by the pressure reduction valve 71, of which moisture, oil compounds and dusts are removed by the micromist filter 73.

Passing of accelerator air, supplied to the accelerator air flow passage 61, across the rotational blade 81 causes the rotational cylinder portion 79, having the terminal member 83, to rotate relative to the outer wall 59 via the bearing 77. Further, such accelerator air passes through the bearing 77 to cool the bearing 77 while flowing through the jet stream flow passage 85 and, thereafter, is sprayed from the spray nozzle 21*a* formed thereon to the bore inner surface 19*a*. Accelerator air injected through the spray nozzle 21*a* accompanies heat of the combustion flame 53, delivered from atomizing air, to form a hot blast 91 (that corresponds to the combustion flame 35 in the first embodiment), as shown in FIG. 10A, which in turn is sprayed onto the bore inner surface 19*a* to begin preheating.

Under such a condition, as shown in FIG. 10A, the distal end of the spraying gun 21 is inserted through the bore inner surface 19*a* of the cylinder 19 to be traveled from such a condition downward in the going stroke. During such translational movement, the wire 23 is not supplied yet and the terminal member 83, equipped with the spray nozzle 21*a* of the spray gun 21, is traveled downward while being rotated, causing the hot blast 91, emitting from the spray nozzle 21*a*, to impinge upon a whole area of the bore inner surface 19*a* of the cylinder 19 to preheat the same.

Subsequently, when the spray gun 21 is traveled further downward below the lowermost end of the bore inner surface 19*a*, i.e., reaches a lower area than a required spray area of the bore inner surface 19*a* and preheating of the bore inner surface 19*a* is completed, supply of accelerator air is interrupted at the time instant $t_2$. This causes atomizing air, flowing through the atomizing air flow passage 55, to form a hot blast 93 injecting downward in place of injection of the hot blast 91 for preheating, as shown in FIG. 10B. Also, interrupting the supply of accelerator air causes rotations of the rotational cylinder portion 79 and the terminal member 83 to be interrupted.

Upon interruption of supply of accelerator air, the wire 23 begins to be supplied to the wire feeder aperture 47 from the wire feeder 25 at the time instant $t_2$. The wire 23 supplied in such a way is molten with the hot blast 93 and scattered downward together with the hot blast 93 without being directed to the bore inner surface 19*a*. Also, it may be structured such that, at the time instant $t_2$, supply of accelerator air is not completely interrupted to cause the pressure to drop to a zero level but the pressure is reduced to such a low level as to preclude the wire 23, molten with the hot blast 93 which is affected with accelerator air, from reaching the bore inner surface 19*a*.

Thereafter, at the time instant $t_3$, accelerator air is supplied again to the accelerator air flow passage 61 under a supply pressure of 1.5 MPa while the spraying gun 21 is traveled upward in the returning stroke as shown in FIG. 10C. With accelerator air being supplied again in such a way, the hot blast ejecting in compliance with accelerator air sprayed from the spray nozzle 21*a* accompanies with the molten wire 23 which is sequentially fed, forming the spraying particles 95 which in turn are sprayed at a spraying angle, i.e., at the same inclined angle $\alpha$ as that of the first embodiment in a rearward area of the translational movement of the spraying gun 21. As a result, as shown in FIGS. 7 and 8, the bore inner surface 19*a* is formed with the sprayed coating film 39. The angle at which the molten particles 95 are sprayed is able to be variably determined by suitably setting the relationship between the injecting direction and the injecting pressure of atomizing air and the injecting direction and the injecting pressure of accelerator air, and not only the spraying angle is merely settled at a fixed value, but also the spraying angle can be freely determined within the range of the spraying angle described in conjunction with the second embodiment.

Here, even during upward movement of the spraying gun 21 as shown in FIG. 10C, the terminal member 83 equipped with the spray nozzle 21*a* rotates due to accelerator air. For this reason, upward movement of the spraying gun 21 allows the sprayed coating film 39 to be formed over a nearly whole area of the bore inner surface 19*a*.

With the structure set forth above, since atomizing air and accelerator air are treated in mutually separate systems, the pressure under which atomizing air is supplied can be maintained at an appropriate value of 0.5 MPa, and the pressure under which accelerator air is supplied can be maintained at and supplied at a higher value of 1.5 MPa than that of atomizing air.

Increasing the pressure, under which accelerator air is supplied, in such a manner enables the speed, at which the spraying particles 95 are scattered, to be maintained at a high level while permitting the spraying angle of the spraying particles 95 to be oriented in the rearward area of the traveling direction of the spraying gun, with a resultant capability of increasing a kinetic energy of the spraying particles 95 impinging upon the bore inner surface 19*a*. As a result, the sprayed coating film 39 is formed over the bore inner surface 19*a* in a further thin state to provide an increased flatness rate, resulting in an increase in the adhesive force relative to the bore inner surface 19*a* and an improvement in the film properties such as a surface roughness of the sprayed coating film.

Further, the wire 23 begins to be supplied under the condition shown in FIG. 10B, and after the wire 23 begins to be supplied, the supply of accelerator air is interrupted under the condition prior to the upward travel of the spraying gun 21. As a consequence, when this takes place, the downwardly oriented hot blast 93 is created, and the spraying particles of the molten wire 23 with such hot blast 93 are ejected toward the opening portion of the lower end of the cylinder block 19. This reliably enables the sprayed coating film from being formed over an inner surface of a skirt portion 97 of the cylinder block 19, where there is no need for forming the sprayed coating film, without preparing a masking.

Further, since the bearing 77, which integrally rotates the rotational cylinder portion 79 and the terminal member 83, is located in the accelerator air flow passage 61, the bearing 77, which is apt to be brought into a high temperature due to heat radiated from the combustion flame 53, is cooled with accelerator air to provide an improved durability.

Further, since moisture and oil components are removed from accelerator air by the micromist filter 73, the bearing 77 is supplied with pure water with no inclusion of moisture and oil components, and thus a performance of the bearing 77 is sustained at a high level for a prolonged time interval.

Furthermore, since the supply of accelerator air is commenced at the time instant $t_1$ after the elapse of the given time interval subsequent to the beginning of the supply of atomizing air and the forming of the combustion flame 53, it becomes possible for the combustion flame 53 to be stabilized.

Also, to say that the directions, in which the hot blast 91 shown in FIG. 10A and the spraying particles 95 shown in FIG. 10C, need to be oriented in a direction intersecting the direction of the translational movement of the spraying gun 21 whereas, on the other hand, the direction, in which the hot blast 93 shown in FIG. 10B is injected, needs to be substantially parallel to the direction in which the spraying gun 21 travels for the translational movement, if it is expressed that the direction, in which the hot blast and the spraying particles of the spraying gun 21 are sprayed, is angled with respect to the central axis X of the spraying gun 21, it is concluded that its maximum range may fall in a value ranging from 0° to 90°.

Finally, by using the structure of the presently filed embodiment, the central axis of the spraying gun 21 is inserted along the central axis X of the bore inner surface 19*a* of the cylinder block 19 in alignment with the axis X whereupon the spraying gun 21 is traveled for translational movement along the central axis direction at a speed in a range between 90 and 160 mm/min while being rotated about the central axis, thereby obtaining the relationship between a spraying and scanning speed, which is the speed in a circumferentially peripheral direction on a circumference of the bore inner surface 19*a* of the cylinder block 19, and the maximum temperature difference on the circumference of the bore inner surface 19*a*.

Figure 11:
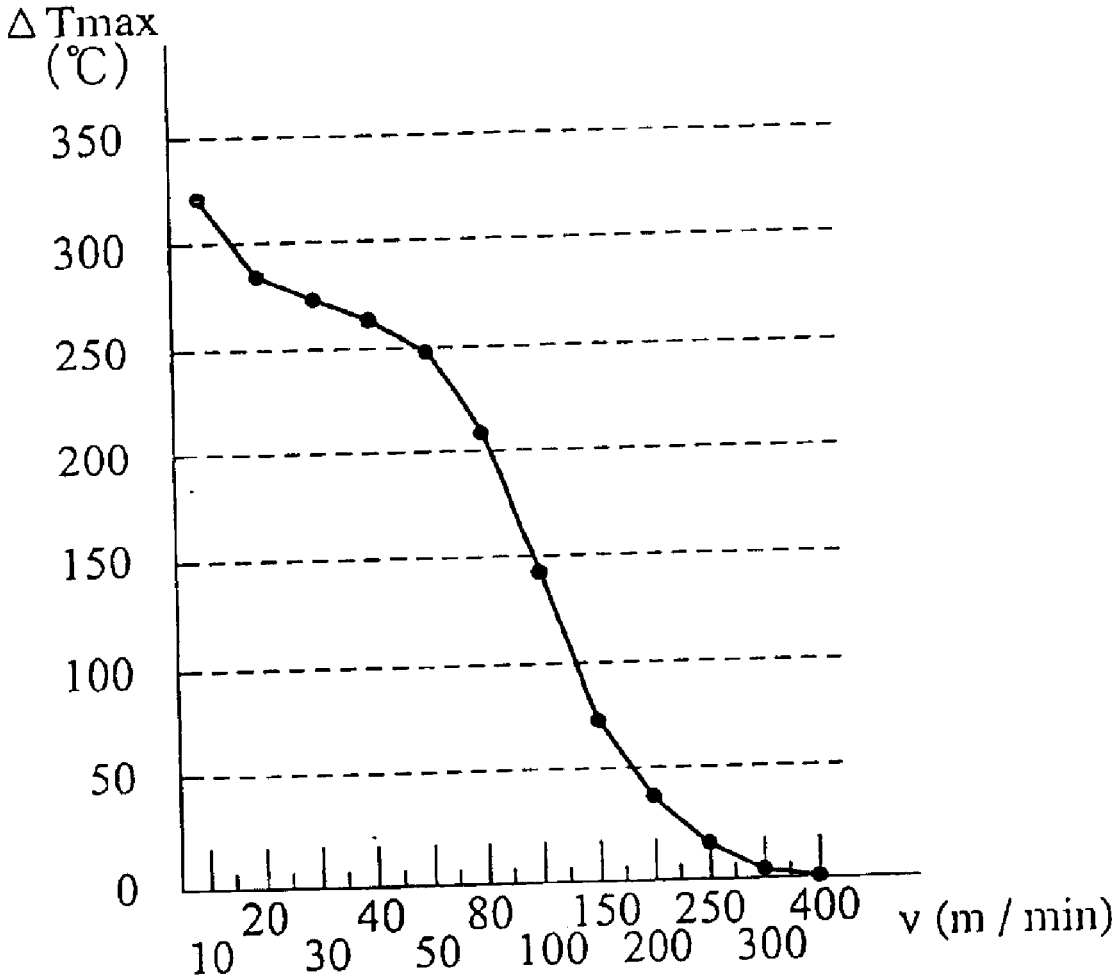
FIG. 11 is a graph illustrating the relationship between a spraying and scanning speed and the maximum temperature difference on a circumference of the cylindrical inner surface of the component in the spraying gun device of the presently filed embodiment.
Figure 12:
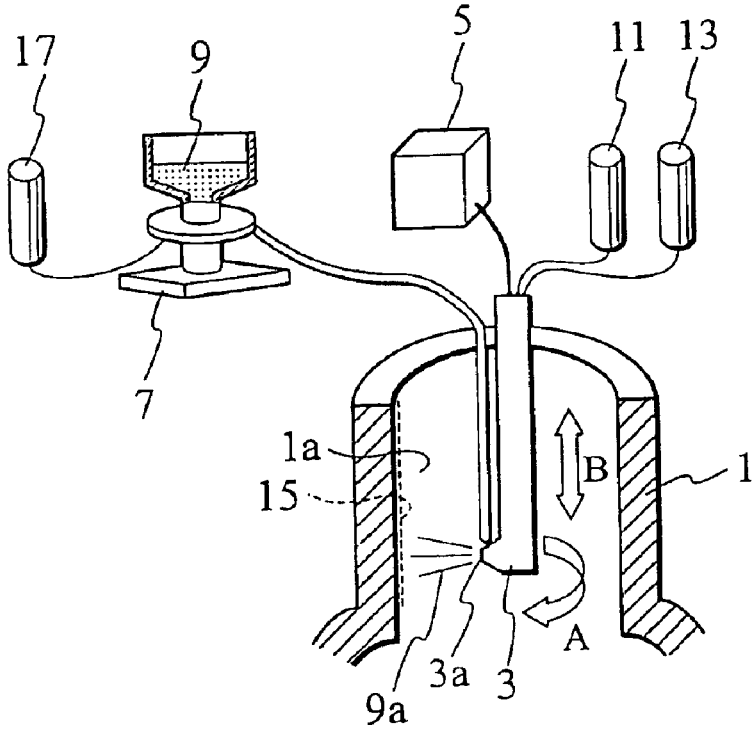
FIG. 12 is an illustrative view of a step of forming the sprayed coating film over the cylindrical inner surface of the component in the structure according to studies conducted by the present inventors.
Figure 13:
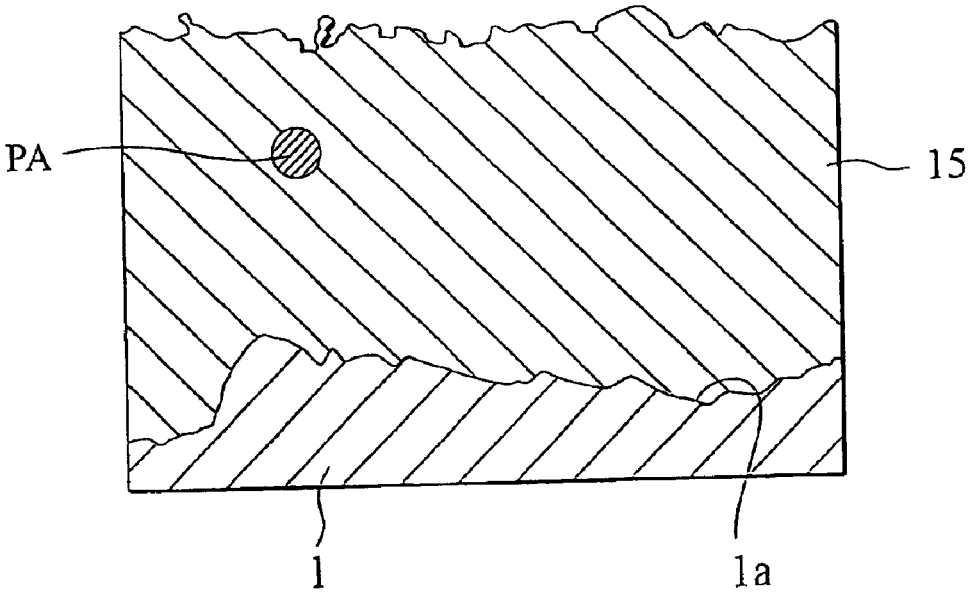
FIG. 13 is a schematic cross sectional view illustrating a status where the cylindrical inner surface of the component is formed with the sprayed coating film by the steps shown in FIG. 12.
Figure 14A:
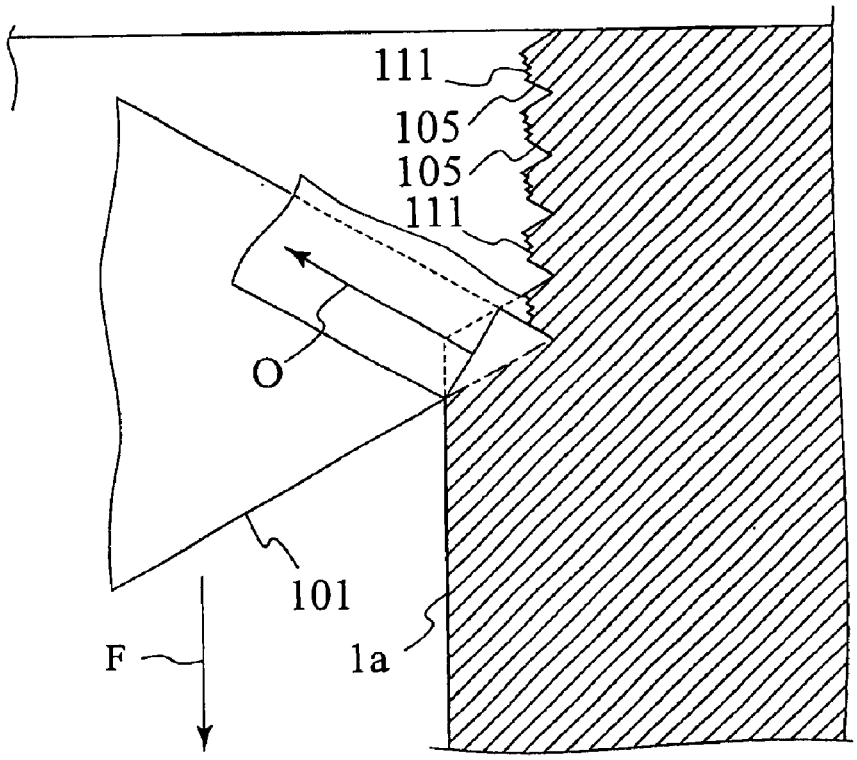
FIG. 14A is a schematic cross sectional view illustrating a flowing status of a swarf occurring during cutting operation when used with a screw cutting tool, according to studies of the present inventors, to execute cutting operation to the cylindrical inner surface of the component.
Figure 14B:
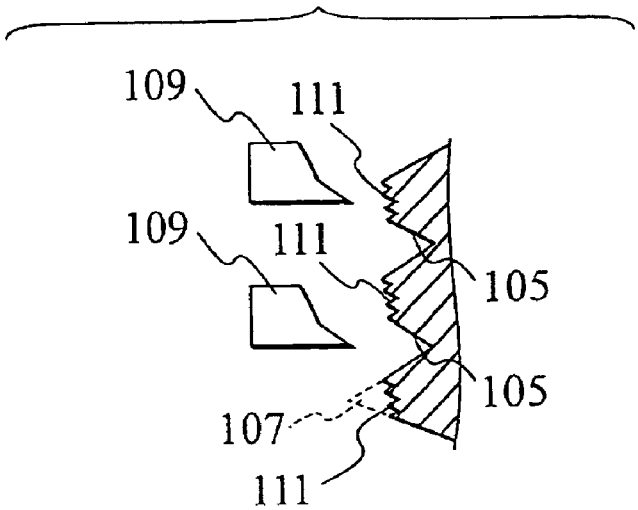
FIG. 14B is a schematic cross sectional view illustrating a status where a fractured surface is formed while causing the swarf during cutting operation shown in FIG. 14A.

FIG. 11 illustrates the relationship between the spraying and scanning speed v, in the circumferential direction on the circumference of the bore inner surface 19*a* of the cylinder block 19, obtained when causing the spraying gun 21 to travel under such conditions for translational movement while being rotated, and the maximum temperature difference $\Delta T_{MAX}$ on the circumference of the bore inner surface 19*a*.

As will be understood with reference to FIG. 11, it appears that as the spraying and scanning speed is increased, the maximum temperature difference in the bore inner surface 19*a* of the cylinder block 19 decreases and no unevenness occurs in the temperature distribution of the bore inner surface 19*a* with the temperature distribution being equalized. Upon study conducted here, it is conceived that the larger the high temperature area in the temperature distribution of the bore inner surface 19*a*, the greater will be the stress due to the heat to cause distortion in the cylinder block 19 and, in some instances, a mechanical strength of the cylinder block 19 is affected. Also, even in a case where there is no substantial influence on the mechanical strength of the cylinder block 19, it is conceived that since residual stress is caused in the sprayed coating film that is formed, deterioration occurs in the film properties such as the strength and adhesive force of the sprayed coating film.

More particularly, from the point of view of substantial removal of influence of residual stress to be caused in the sprayed coating film, it is understood that the maximum temperature difference in the bore inner surface 19*a* of the cylinder block 19 is preferably equal to or less than 150° C. and, so, the substantially associated spraying and scanning speed in the circumferential direction on the circumference of the bore inner surface 19*a* may fall in a value equal to or higher than 100 m/min. Also, in consideration of a case where, in a vicinity of the bore inner surface 19*a*, the cylinder block 19 is formed in a thin film, it is said that the maximum temperature difference of the bore inner surface 19*a* is preferably equal to or less than 40° C. and the substantially associated spraying and scanning speed is more preferable to be a value equal to or higher than 200 m/min.

Further, the tendency set forth above is similarly confirmed in the connecting rod discussed in conjunction with the first embodiment.

Furthermore, while the presently filed embodiment has been described mainly based on the first embodiment, the presently filed embodiment may of course be suitably applied to the structure of the second embodiment where the cylindrical inner surface is subjected to the screw processing and formed in the rough surface.

Although the present invention has been described above on the basis of the various embodiments, of course, the present invention is not limited to the various embodiments set forth above in some sense, it goes without saying that various modifications may be possible in a range without departing from the spirit and scope of the present invention.

What is claimed is:

1. A method of manufacturing a product having a sprayed coating film, the method comprising:

preparing a component having a cylindrical inner surface;

preparing a gas spray type spraying gun with a central axis in opposed relationship with the cylindrical inner surface of the component to be aligned with a central axis of the cylindrical inner surface;

supplying spraying material to the spraying gun;

melting the spraying material with a combustion flame; and traveling the spraying gun for translational movement in a traveling direction, corresponding to one of directions of the central axis of the cylindrical inner surface, and forming a sprayed coating film over the cylindrical inner surface while spraying the spraying material, molten with the combustion flame, onto the cylindrical inner surface in a spraying direction oriented in a rearward area of the traveling direction for thereby obtaining a product having the sprayed coating film on the cylindrical inner surface, wherein the spraying gun includes a first gas flow passage in which a first gas flows to deliver the spraying material, molten with the combustion flame, in one of directions of the central axis and a second gas flow passage in which a second gas flows to deliver the spraying material, delivered in the one of directions, toward a direction intersecting the one of directions, the first and second gas flow passages being comprised of mutually separate systems and a pressure of the second gas being higher than a pressure of the first gas, and wherein the spraying gun is rotated about the central axis during the movement in the cylindrical inner surface.

2. The method according to claim 1, wherein the spraying gun is rotated at a peripheral speed, in terms of the cylindrical inner surface, equal to or greater than 100 m/min.

3. The method according to claim 1, wherein, when the spraying material, molten with the combustion flame, is not sprayed from the spraying gun, a supply of or a pressure of the second gas is interrupted or reduced.

4. The method according to claim 1, wherein the first gas flow passage is provided around an outside periphery of a supply section through which the spraying material is supplied, the second gas flow passage is provided around an outside periphery of the first gas flow passage, and a bearing is provided in the second gas flow passage to allow the second gas to pass therethrough, whereby the bearing is able to rotate a portion of the second gas flow passage with respect to the first gas flow passage.

5. The method according to claim 4, wherein a filter filtering the second gas is provided at an upstream of the bearing in the second gas flow passage.

6. The method according to claim 1, wherein the second gas is supplied when a given time interval is elapsed after the combustion flame is formed and the first gas is supplied.

7. The method according to claim 1, wherein the product includes a cylinder block of an engine and made of aluminum alloy, and the cylindrical inner surface includes a bore inner surface of the cylinder block, the spraying material including metallic material principally composed of iron.

8. The method according to claim 1, wherein the product includes a connecting rod of an engine and made of material principally composed of iron, and the cylindrical inner surface includes an inner surface of a large terminal portion of the connecting rod, the spraying material including metallic material principally composed of an alloy of aluminum and copper.

9. A method of manufacturing a product having a sprayed coating film, the method comprising:

preparing a component having a cylindrical inner surface:

preparing a gas spray type spraying gun with a central axis in opposed relationship with the cylindrical inner surface of the component to be aligned with a central axis of the cylindrical inner surface;

supplying spraying material to the spraying gun;

melting the spraying material with a combustion flame; and traveling the spraying gun for translational movement in a traveling direction, corresponding to one of directions of the central axis of the cylindrical inner surface, and forming a sprayed coating film over the cylindrical inner surface while spraying the spraying material, molten with the combustion flame, onto the cylindrical inner surface in a spraying direction oriented in a rearward area of the traveling direction for thereby obtaining a product having the sprayed coating film on the cylindrical inner surface, wherein the spraying gun includes a first gas flow passage in which a first gas flows to deliver the spraying material, molten with the combustion flame, in one of directions of the central axis and a second gas flow passage in which a second gas flows to deliver the spraying material, delivered in the one of directions, toward a direction intersecting the one of directions, the first and second gas flow passages being comprised of mutually separate systems and a pressure of the second gas being higher than a pressure of the first gas, and wherein the direction in which the spraying gun is pulled out from the cylindrical inner surface for returning movement corresponds to the traveling direction that corresponds to the one of directions of the central axis, and a direction in which the spraying gun is inserted through the cylindrical inner surface for going movement corresponds to the traveling direction that corresponds to another one of directions of the central axis, whereby during the going movement, the cylindrical inner surface is preheated with the combustion flame and during the returning movement, the spraying material is sprayed onto the cylindrical inner surface preheated during the going movement.

10. A method of manufacturing a product having a sprayed coating film, the method comprising:

preparing a component having a cylindrical inner surface;

preparing a gas spray type spraying gun with a central axis in opposed relationship with the cylindrical inner surface of the component to be aligned with a central axis of the cylindrical inner surface;

supplying spraying material to the spraying gun;

melting the spraying material with a combustion flame; and traveling the spraying gun for translational movement in a traveling direction, corresponding to one of directions of the central axis of the cylindrical inner surface, and forming a sprayed coating film over the cylindrical inner surface while spraying the spraying material, molten with the combustion flame, onto the cylindrical inner surface in a spraying direction oriented in a rearward area of the traveling direction for thereby obtaining a product having the sprayed coating film on the cylindrical inner surface, wherein the cylindrical inner surface is formed with a recess portion that is formed by a screw cutting process, and a fractured surface formed, at a given inclined angle with respect to the central axis of the cylindrical inner surface, in such a way that a ridge portion to be formed in the screw cutting process is scraped by a swarf when occurring in the screw cutting process, wherein an angle between the spraying direction of the spraying gun and the central axis is greater than the given angle of the fractured surface.

11. The method according to claim 10, wherein the spraying direction remains at an angle in a range greater than 44° C. and less than 90° C. with respect to the central axis.

12. The method according to claim 10, wherein the spraying gun includes a first gas flow passage in which a first gas flows to deliver the spraying material, molten with the combustion flame, in one of directions of the central axis and a second gas flow passage in which a second gas flows to deliver the spraying material, delivered in the one of directions, toward a direction intersecting the one of directions, the first and second gas flow passages being comprised of mutually separate systems and a pressure of the second gas being higher than a pressure of the first gas.

13. A method of manufacturing a product having a sprayed coating film, the method comprising:

providing a component having a cylindrical inner surface;

aligning a spraying gun having a central axis with a central axis of the cylindrical inner surface;

supplying a spraying material to the spraying gun;

melting the spraying material with a combustion flame to form a molten spraying material;

moving the spraying gun in a direction along the central axis of the cylindrical inner surface;

providing a first gas flow for delivering the molten spraying material in a direction of the central axis of the spraying gun; and providing a second gas flow for delivering the molten spraying material in a direction that intersects a direction of the central axis of the spraying gun and that is angled rearwardly from the direction of motion of the spraying gun to thereby form a sprayed coating on the inner cylindrical surface of the component, wherein first and second gases flow in respective first and second gas flow passages comprised of mutually separate systems, wherein a pressure of the second gas is higher than a pressure of the first gas, and wherein the spraying gun is rotated about the central axis during the movement in the cylindrical inner surface.

* * * * *